US009187895B2

(12) United States Patent
Rodriguez Carassus

(10) Patent No.: US 9,187,895 B2
(45) Date of Patent: Nov. 17, 2015

(54) SELF-LOCKING BLOCK AND COMPLEMENTARY PIECES FOR THE RAISING OF PILLARS AND FREE-STANDING WALLS

(71) Applicant: Alberto Rodriguez Carassus, Montevideo (UY)

(72) Inventor: Alberto Rodriguez Carassus, Montevideo (UY)

( * ) Notice: Subject to any disclaimer, the term of this patent is extended or adjusted under 35 U.S.C. 154(b) by 0 days.

(21) Appl. No.: 14/103,465

(22) Filed: Dec. 11, 2013

(65) Prior Publication Data

US 2015/0159371 A1 Jun. 11, 2015

Related U.S. Application Data

(63) Continuation-in-part of application No. 13/073,232, filed on Mar. 28, 2011, now abandoned.

(51) Int. Cl.

| | |
|---|---|
| ***E04B 2/08*** | (2006.01) |
| ***E04B 2/06*** | (2006.01) |
| ***E04B 2/44*** | (2006.01) |
| ***E04B 2/18*** | (2006.01) |
| *E04B 2/02* | (2006.01) |

(52) U.S. Cl.
CPC ... *E04B 2/06* (2013.01); *E04B 2/18* (2013.01); *E04B 2/44* (2013.01); *E04B 2002/0217* (2013.01)

(58) Field of Classification Search
CPC ..... E04B 2/18; E04B 2002/0217; E04B 2/08; E04B 2/06; E04B 2/44; E04C 2003/023
USPC ..... 52/396.08, 396.09, 503–505, 223.7
See application file for complete search history.

(56) References Cited

U.S. PATENT DOCUMENTS

| | | | | | |
|---|---|---|---|---|---|
| 3,618,279 | A | * | 11/1971 | Sease | 52/223.7 |
| 4,026,086 | A | * | 5/1977 | Langley | 52/592.6 |
| 4,107,894 | A | * | 8/1978 | Mullins | 52/592.6 |
| 4,297,816 | A | * | 11/1981 | Kella et al. | 52/125.3 |
| 4,314,431 | A | * | 2/1982 | Rabassa | 52/259 |
| 4,573,301 | A | * | 3/1986 | Wilkinson | 52/607 |
| 4,651,485 | A | * | 3/1987 | Osborne | 52/284 |
| 4,965,979 | A | * | 10/1990 | Larrivee et al. | 52/592.6 |
| 5,082,501 | A | * | 1/1992 | Kurz | 106/789 |
| 5,537,796 | A | * | 7/1996 | Kliethermes, Jr. | 52/592.6 |
| 5,715,635 | A | * | 2/1998 | Sherwood | 52/286 |
| 5,966,889 | A | * | 10/1999 | Zinner | 52/606 |
| 5,987,840 | A | * | 11/1999 | Leppert | 52/592.6 |
| 6,088,987 | A | * | 7/2000 | Simmons et al. | 52/592.6 |
| 6,161,357 | A | * | 12/2000 | Altemus | 52/592.6 |
| 6,423,134 | B1 | * | 7/2002 | Trottier et al. | 106/802 |
| 6,571,525 | B2 | * | 6/2003 | Coleman | 52/592.5 |
| 6,572,697 | B2 | * | 6/2003 | Gleeson et al. | 106/705 |

(Continued)

FOREIGN PATENT DOCUMENTS

| | | | | |
|---|---|---|---|---|
| DE | 2544196 | A | * | 4/1977 |
| EP | 273181 | A2 | * | 7/1988 |

(Continued)

*Primary Examiner* — Elizabeth A Plummer
(74) *Attorney, Agent, or Firm* — Defillo & Associates, Inc.; Evelyn A. Defillo

(57) ABSTRACT

The disclosure concerns to rooms or buildings constructed by raising walls using prefabricated blocks made of Portland cement mortar reinforced with steel fibers. The prefabricated blocks are stable without requiring a mortar mixture, or any additional internal or external structural support for the construction of the walls.

1 Claim, 10 Drawing Sheets

(56) References Cited

U.S. PATENT DOCUMENTS

Figure 1:
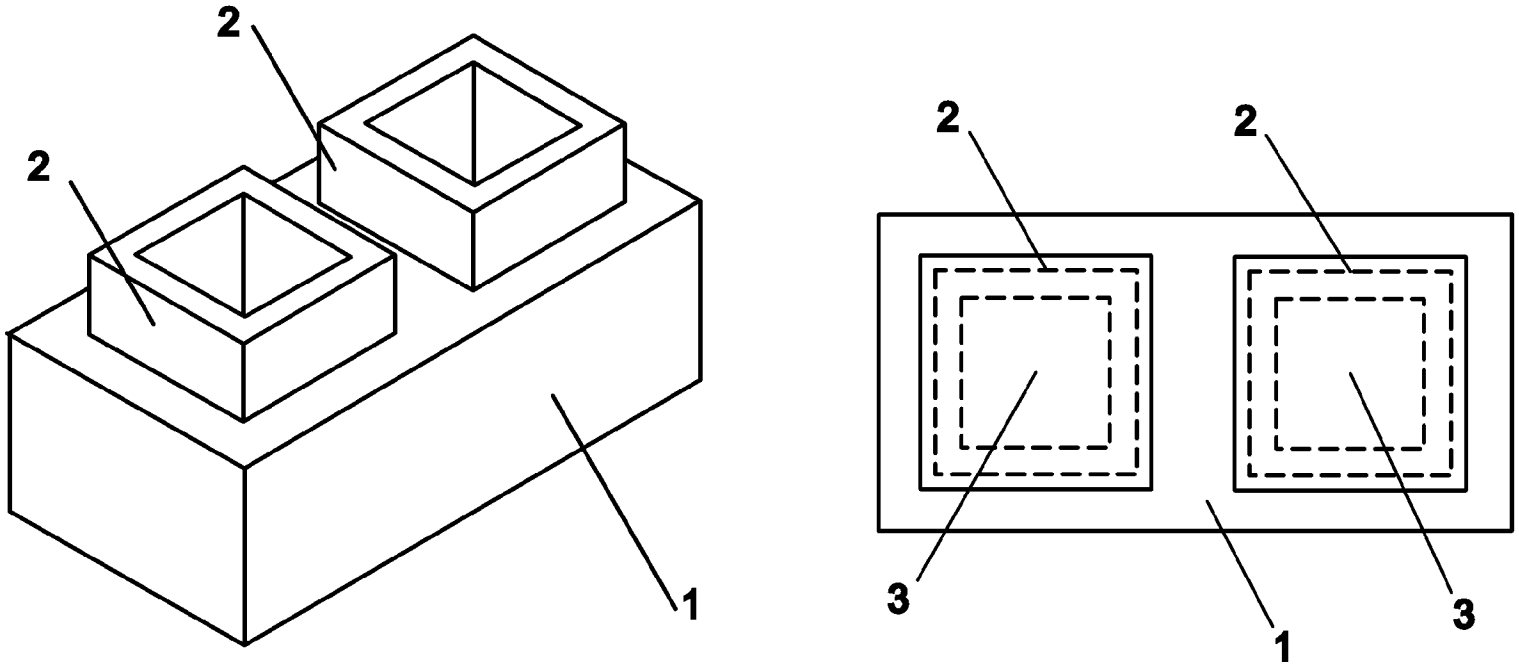

| | | | | |
|---|---|---|---|---|
| 6,588,168 | B2 * | 7/2003 | Walters | 52/604 |
| 6,758,020 | B2 * | 7/2004 | Cerrato | 52/606 |
| 6,881,256 | B2 * | 4/2005 | Orange et al. | 106/644 |
| 6,948,282 | B2 * | 9/2005 | Bott | 52/98 |
| 7,086,811 | B2 * | 8/2006 | Lewis | 405/284 |
| 2004/0226246 | A1 * | 11/2004 | Doty | 52/503 |
| 2006/0201082 | A1 * | 9/2006 | Hammer et al. | 52/223.5 |
| 2008/0216436 | A1 * | 9/2008 | Rodriguez Carassus | 52/588.1 |
| 2009/0314186 | A1 * | 12/2009 | Rodgers | 106/706 |
| 2011/0225909 | A1 * | 9/2011 | Rodriguez Carassus | 52/261 |

FOREIGN PATENT DOCUMENTS

| | | | |
|---|---|---|---|
| EP | 417064 | A2 * | 3/1991 |
| JP | 05310460 | A * | 11/1993 |

* cited by examiner

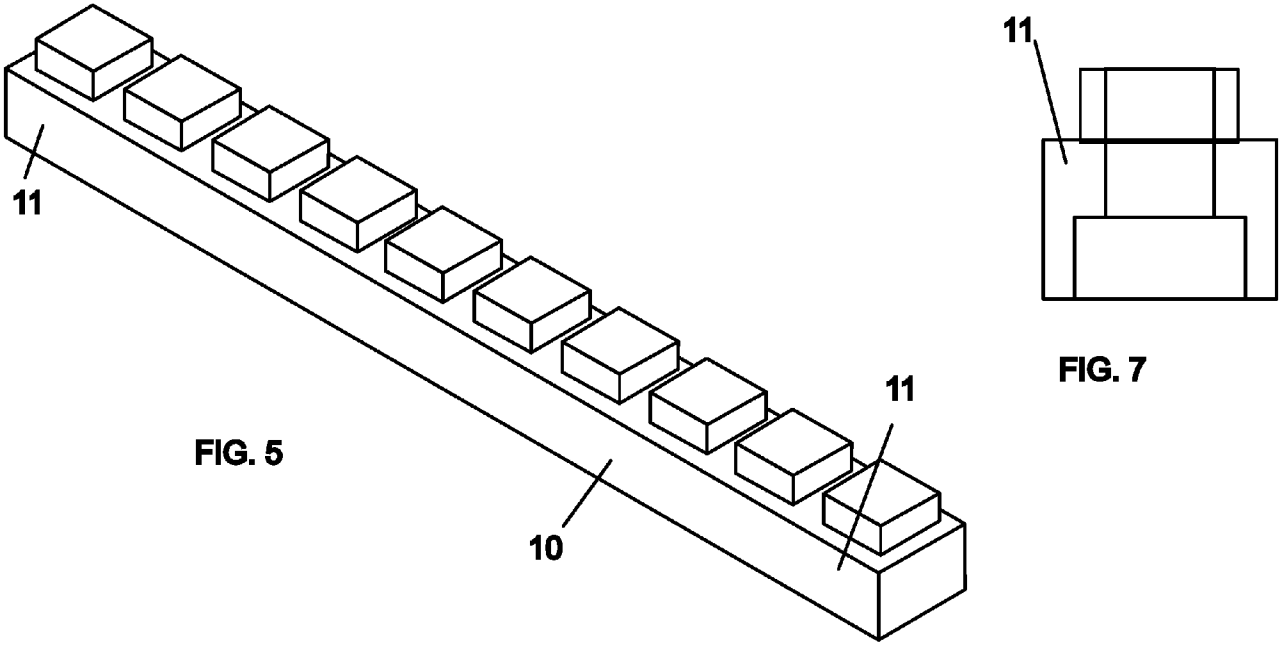
FIG. 5
FIG. 7
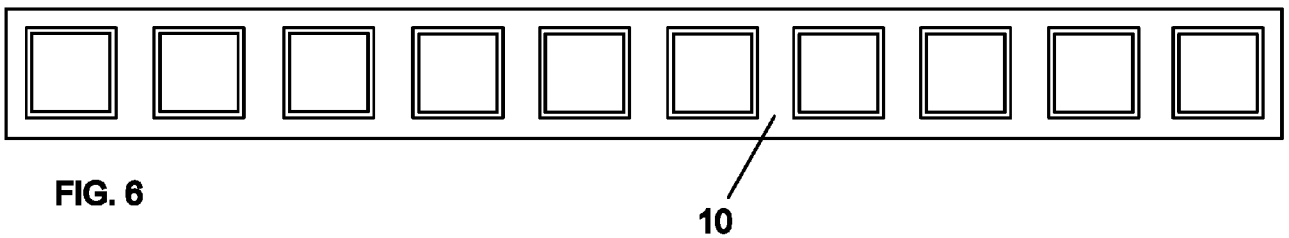
FIG. 6

SELF-LOCKING BLOCK AND COMPLEMENTARY PIECES FOR THE RAISING OF PILLARS AND FREE-STANDING WALLS

RELATED U.S. APPLICATION

This application is a continuation-in-part of U.S. application Ser. No. 13/073,232 filed Mar. 28, 2011, entitled "SELF-LOCKING BLOCK AND COMPLEMENTARY PIECES FOR THE RAISING OF PILLARS AND FREE-STANDING WALLS", pending, which is a continuation-in-part of U.S. application Ser. No. 12/123,783 filed May 20, 2008, entitled "SELF-LOCKING BLOCK AND COMPLEMENTARY PIECES FOR THE RAISING OF PILLARS AND FREE-STANDING WALLS", abandoned, the disclosure of both applications, which are incorporated herein by reference.

TECHNICAL FIELD

The present invention relates to the construction field. More specifically, the present invention relates to prefabricated blocks suitable for the construction of pillars, walls, rooms, and buildings that do not require the use of any external or internal structural support, adhesive, mortar mixture, or support beams.

BACKGROUND OF THE INVENTION

The construction industry is continuously searching for ways to obtain firmness, stability, and high resistance for the use of prefabricated pieces destined to raise walls, rooms, and buildings.

In many cases, the use of larger amounts of elements for the raising of walls has been avoided so the task becomes as simple as possible for the workers without qualification or even by the future occupants of the house.

Unfortunately, the proposed solutions for prefabricated pieces of the prior art that do not require the use of a mortar mixture did not offer satisfactory levels of firmness, stability, or high resistance. At the same time, the proposed solutions in the matter of fit in prefabricated pieces had demonstrated that the use of elements to help in the construction as metal supports or beams had not been totally avoided.

Additionally, the proposed solutions until this moment have not allowed obtaining a suitable finish for the walls including openings for doors and windows or for forming the 90 degree angle when connecting two walls to form a room.

The present invention proposes an alternative to solve these problems.

The present invention includes a prefabricated block and complementary blocks that allows the user to build pillars, walls, rooms, and buildings without the need of an external or internal structural support, adhesive, mortar mixture, support beams, or plaster. The prefabricated blocks and complementary blocks interconnect between themselves and are made of Portland cement mortar reinforced with steel fibers. The Portland cement mortar reinforced with the steel fibers provides the block with enough strength so that the wall, room, or building can be raised without the need of external or internal structural support, adhesive, mortar mixture, or support beams.

The pillars, walls, rooms, and buildings constructed by the blocks and complementary blocks of the present invention are self-locking because their connecting mechanism is absent external or internal structural support, adhesive, mortar mixture, or support beams. In addition, the pillars, walls, rooms, and buildings constructed by the blocks and complementary blocks of the present invention are free-standing because they do not require the use of additional external or internal structural support elements.

The complementary blocks may be derived from the design of the block and they are a lintel beam which can also be used as a career beam or crown beam; a head-block; and a semi-block.

The block and complementary blocks interact in a way that is described next, providing a technical alternative for the solution of the described technical problems. By the interaction of these elements, pillars, walls, rooms, and buildings having firmness, stability, and high resistance and free-standing capacity are constructed, obtaining a suitable finish in spaces destined to openings, doors and windows, as well as a suitable encounter between the right angle walls that offer a solid mechanical entailment between the convergent walls.

SUMMARY OF THE INVENTION

The present invention relates to a prefabricated block made of Portland cement mortar reinforced with steel fibers fit in self-locking form, suitable for the raising of firm pillars, walls, rooms, and buildings that are stable without requiring external or internal structural support, adhesive, mortar mixture, or support beams. The blocks are designed to work as elements of a freestanding wall of great strength, able to act without the cooperation of other structural elements. Due to the composition of Portland cement mortar and steel fibers in the appropriate proportions, each block sustains loads of 16 tons during a compression test.

It is also an objective of the present invention to provide complementary block elements derived from the design of the block that complements the block in the task of raising the pillars, walls, rooms, and buildings. They complementary blocks are: lintel beam, head-block, and semi-block.

The block and the complementary block interlock with each other allowing the raising of the pillars, walls, rooms, and buildings by using a dry method.

In the present invention, the term dry method refers to a method that allows raising pillars, walls, rooms, and buildings without the use of a mortar mixture, and any additional external or internal structural support.

Additionally, the high resistance design that the prefabricated material grants to the blocks and the derived complementary block elements does not require plaster, mortar mixture, adhesives, during the construction of the pillars, walls, rooms, or buildings.

DESCRIPTION WITH REFERENCE TO THE DRAWINGS

Figure 2:
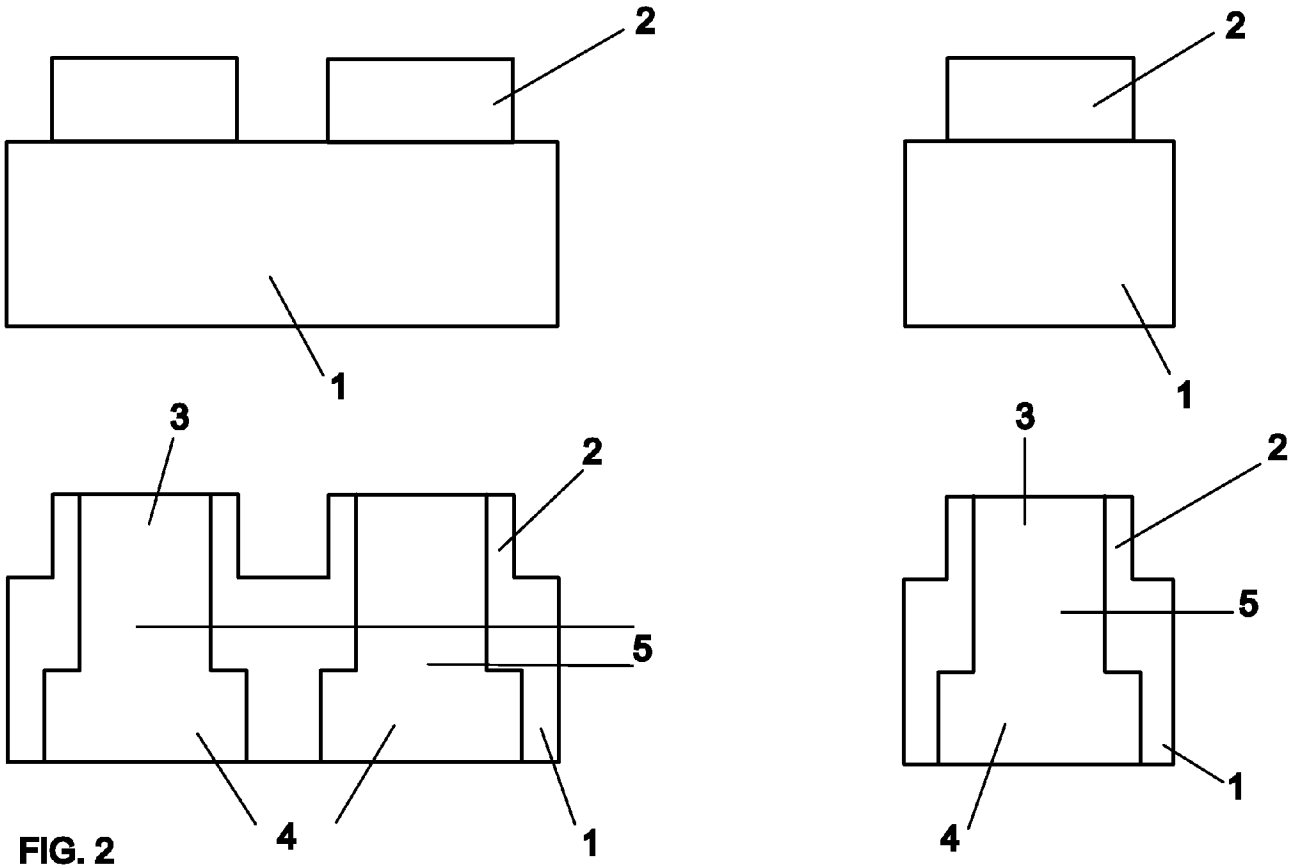

FIG. 1—illustrates a perspective view of the block according to an exemplary embodiment of the present invention. The block is a parallelepiped of rectangular base (1) and the two protrusions 2 that overpass the rectangular base (1). In the same figure a top view is shown where the hollow interior cavities (3) of the base (1) can be seen;

FIG. 2—illustrates a front view, longitudinal section, lateral view, and cross-sectional view of the block showing the parallelepiped of rectangular base (1) of which the two protrusions (2) overpass;

The longitudinal and cross-sectional sections show the two hollow cavities (3) of the base (1), hollow cavities, each one of the hollow cavities (3) includes two segments of straight prismatic form of square base, having each one of them different segment dimensions (4, 5).

Figure 3:
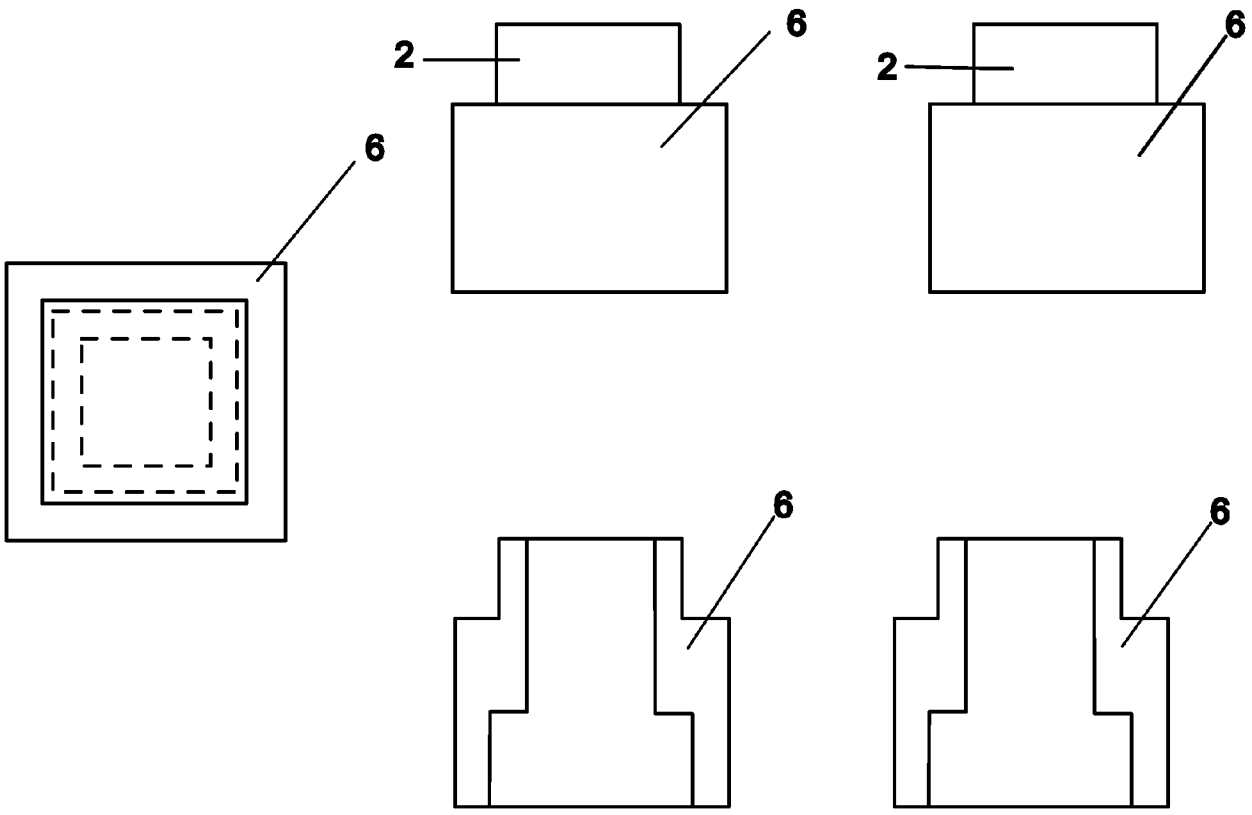
Figure 4:
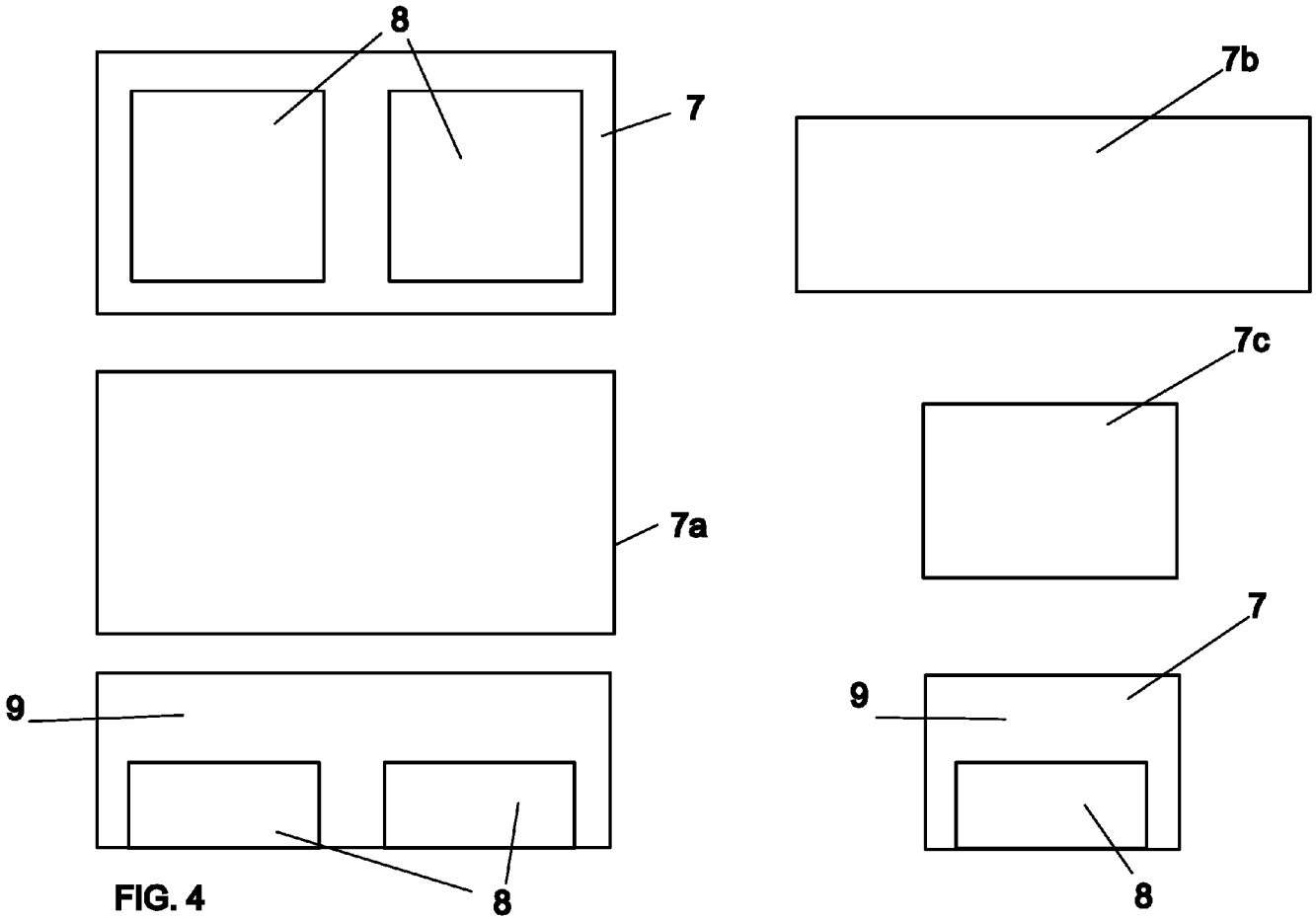
Figure 8:
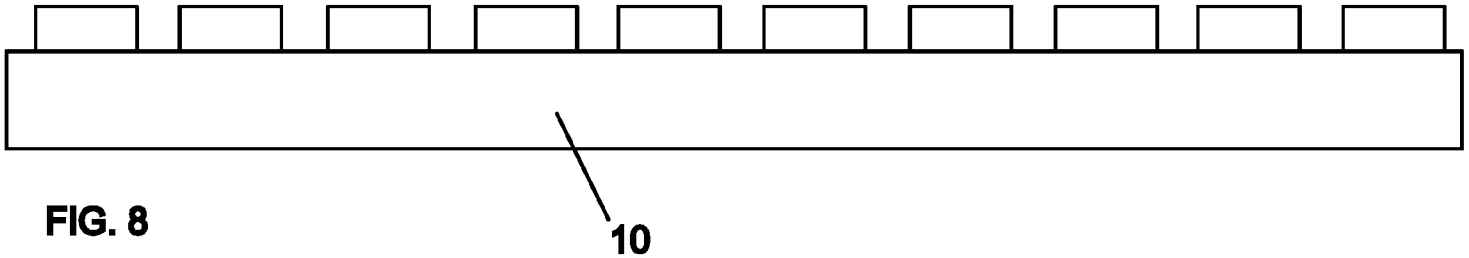
Figure 9:
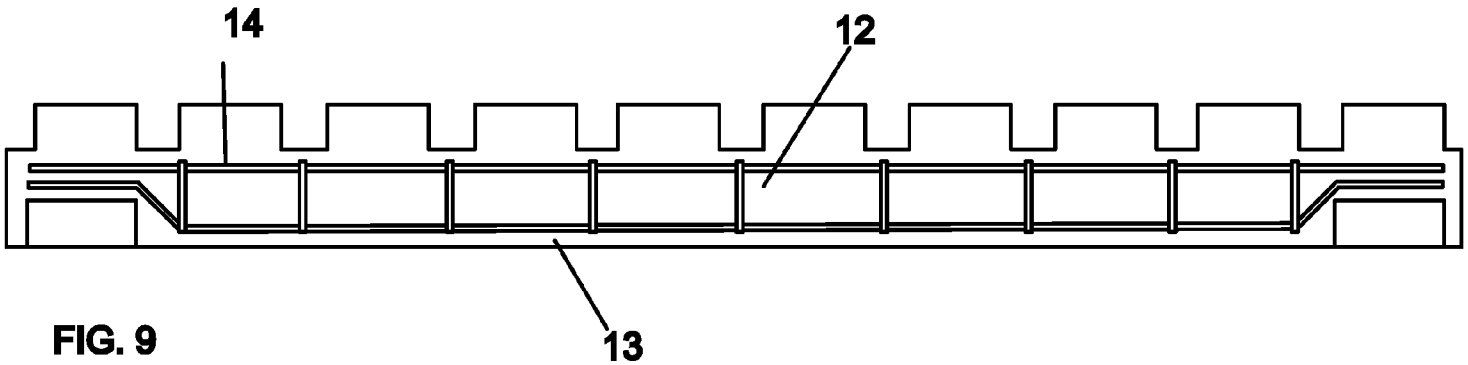
Figure 12:
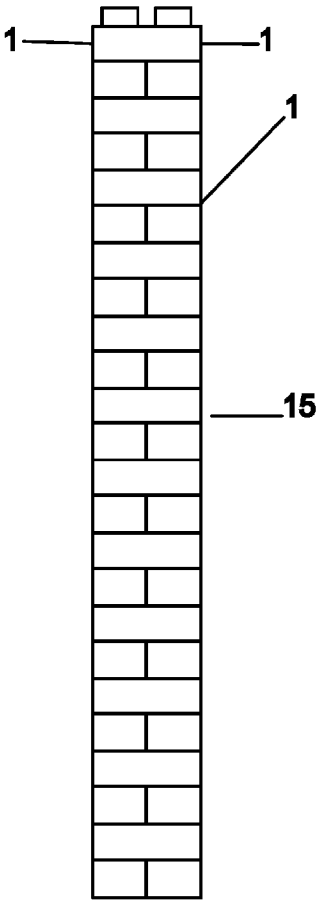
Figure 11:
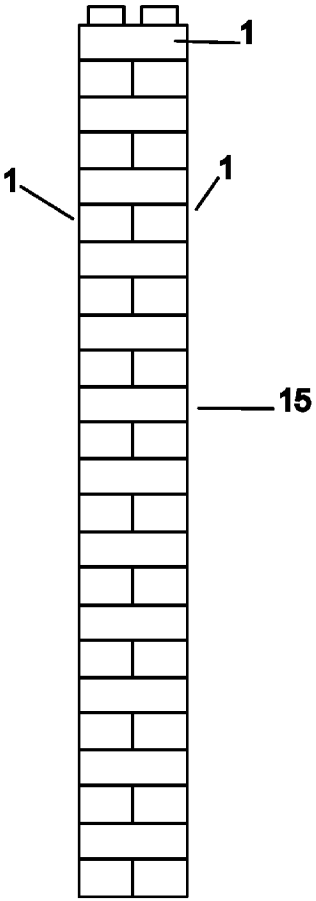
Figure 10:
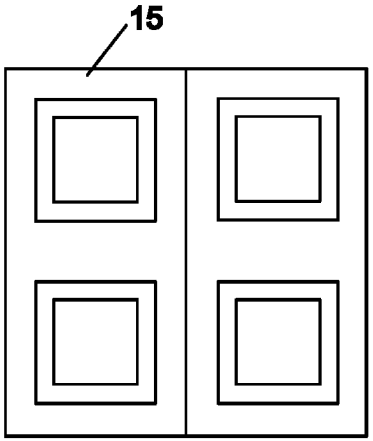
Figure 13:
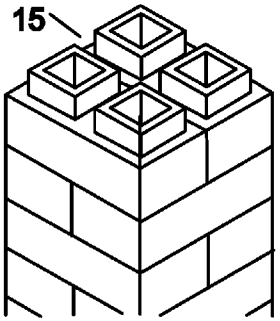
Figure 14:
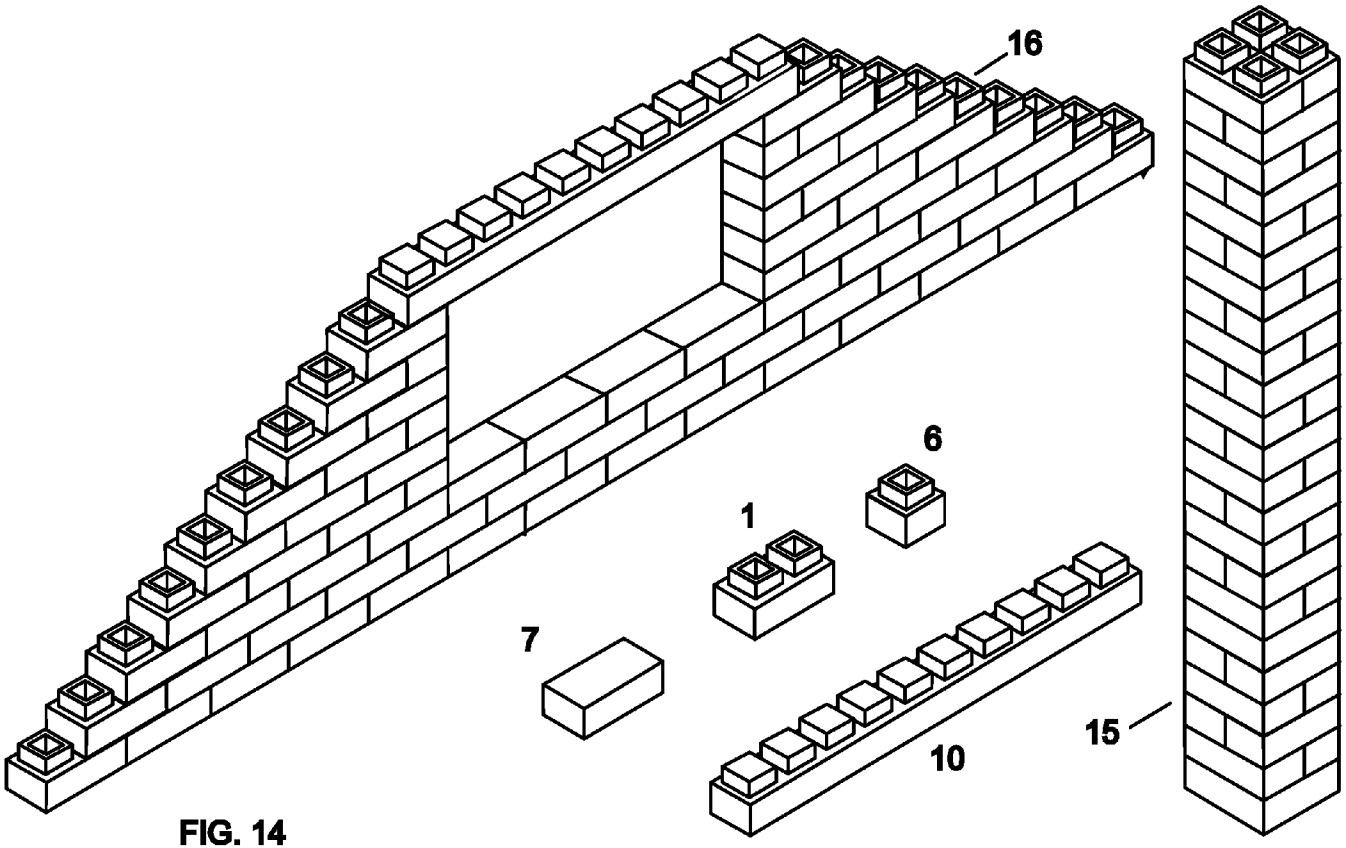
Figure 15:
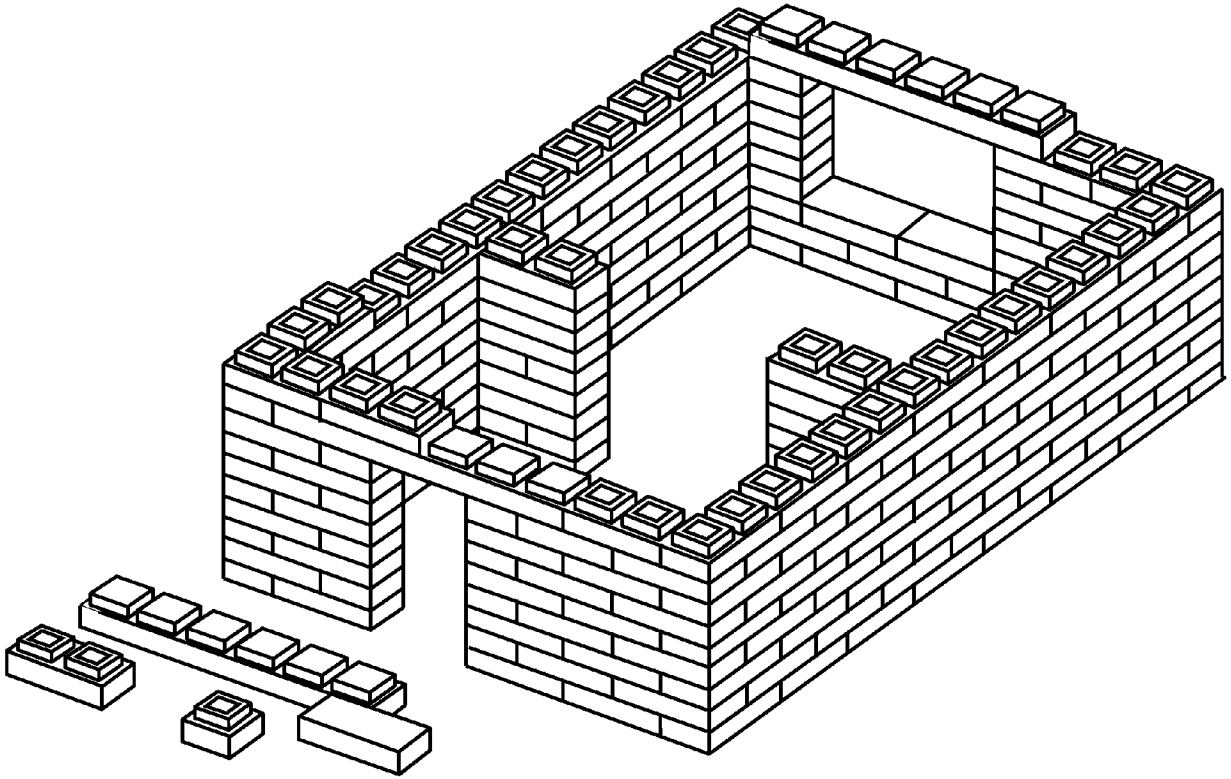
Figure 16:
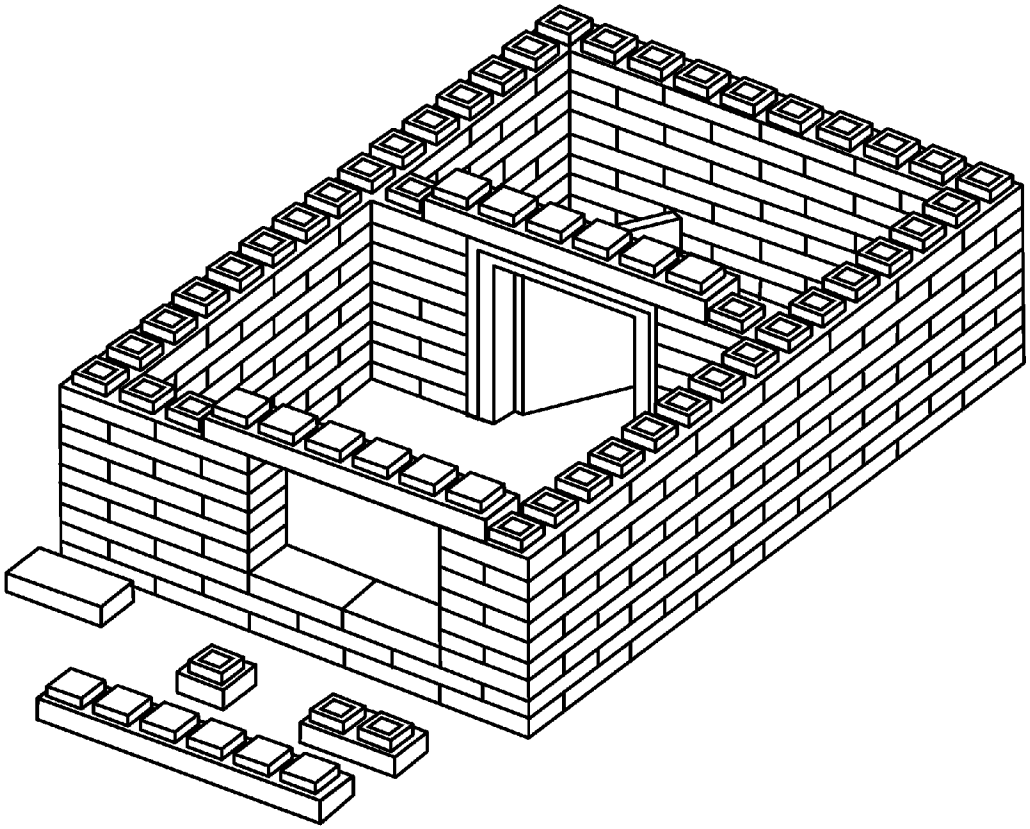

FIG. 3—illustrates a top view, a front view, and a lateral view of the semi-block (6) showing a single protrusion (2);

FIG. 4—illustrates a bottom view of the head-block (7) showing the two hollow cavities (8) symmetrically placed; 7*a* represent a top view of the head-block, 7*b* represents a front view of the head-block, and 7*c* represents a side view of the head-block;

In same FIG. 4, 7 represents a longitudinal cross sectional view of the head-block showing the hollow cavities (8) and the solid superior part (9);

FIG. 5—illustrates a perspective view of the lintel beam (10) showing its two ends (11);

FIG. 6—illustrates a top view of the lintel beam (10) of FIG. 5;

FIG. 7—illustrates a cross-sectional view of one of the ends (11) of the lintel beam;

FIG. 8—illustrates a front view of the lintel beam (10) of FIG. 5;

FIG. 9—illustrates a longitudinal cross sectional view of the lintel beam (10) showing the stirrups (12), the main reinforcement (13) and the secondary reinforcement (14);

FIG. 10—Illustrates a top view of a pillar of square section (15) where two blocks (1) are placed one next to the other;

FIG. 11—illustrates a front view of a pillar of square section (15) showing the alternative disposition of layers of two blocks (1) that link with the superior layers when turning ninety degrees their direction;

FIG. 12—illustrates a back view of a pillar of square section (15);

FIG. 13—illustrates a perspective front view of the superior part of a pillar of square section (15;

FIG. 14—illustrates a wall (16) constructed on the basis of the present system with the use of the block (1), semi-block (6), head-block (7), lintel beam (10). The pieces used are observed at the foot of the representation. Also, a pillar of square section (15) is shown;

FIG. 15—illustrates a perspective front view of a room constructed on the basis of the system according to the present invention;

FIG. 16—illustrates a perspective front view of a building including at least two rooms interconnected by an internal door and constructed on the basis of the system according to the present invention.

DESCRIPTION OF THE INVENTION

The basic piece is constituted by a block. From the shape of the block, the other three mentioned complementary block elements are derived.

The block comprises a parallelepiped of rectangular base 1 whose length is double than its width and its height is a third of the length, with two small identical protrusions 2 that overpass its superior face.

The parallelepiped protrusions overpass the block. Nevertheless, in this chapter, for the single effects to give clarity to the description that follows, reference to the parallelepiped and the protrusions will be made separately.

The base has in its interior two hollow cavities symmetrically disposed. Each one of the hollow cavities is made up of two segments having square base straight prismatic form. The segments are placed one on top of the other and each one of the segments has different dimensions. The superior and inferior ends of the segments are opened.

The system to interconnect the blocks between them is similar to the male/female interconnection system. The inferior segments of each one or both hollow cavities in the parallelepiped are predicted to function like the cavities or female elements in this system.

Both hollow cavities provide the block a favorable contribution to thermal insulation that is desirable in a wall designed to serve as a closing outer wall.

The weight of the block is lightened, allowing easy work manipulation. The approximated weight of the block may be 6.5 kg, for an example, in which the rectangular base blocks have a length of 30 cm, width of 15 cm and a height of 10 cm, obtaining in addition a wall with its own weight of approximately 217 kg/m.sup.2 in walls of 15 cm, comparable to the weight of a plastered solid brick wall of the same thickness.

The two protrusions that overpass the superior face of the base of the block are symmetrically arranged and have a square base straight prismatic form. Each one of the protrusions includes an interior hollow volume also with a straight prismatic form of square base, being the hollow cavities symmetrically located. The superior and inferior ends of the hollow prism are open.

The inferior ends of the hollow cavities of the protrusions are in communication with the superior ends of the hollow cavities of the base, so that each one of the hollow cavities of the protrusions is continued in each one of the hollow cavities of the base.

The main function of the protrusions is to serve as a mechanical bond between the blocks constituting the male element in the mentioned male/female system. Each one of the blocks is fit in with another by introducing the protrusions of one of them in the inferior segments of the hollow cavities of the base.

The interconnection between the blocks of the present invention allows to eliminate the necessity of a mortar mixture because conferring the wall, at the same time, stability and a monolithism similar to the one obtained in a traditional wall with the use of a mortar mixture. It is for this reason that the block is called self-locking.

The system of the present invention allows, in addition, to eliminate the necessity of additional structural elements, such as supports or metal beams, which are use to provide the walls with the necessary raising capacity. The pillars and the walls that are constructed are by design free-standing for important wall height and with a capacity to support reinforced concrete slabs with usual design overloads. Without damage to it, in the case of being needed as a structural reinforcement destined to other aims, this one can be implemented by adding reinforcement and concrete in the continuous hollow columns that are formed in the walls as a product of placing the blocks in successive layers.

The two protrusions allow an average adult worker to take the block comfortably with a single hand, which facilitates its manipulation and positioning in the work area.

As the blocks are fit into one another, walls can be perfectly raised saving in manual labor from the qualitative point of view. Non-specialized workers and people who work under the modality of auto-construction or mutual aid can execute the walls with professional finishing.

A result of the block design and placing them in successive layers is the formation of pillars and walls with continuous vertical hollow columns in its interior.

Another result of both is the greater yield per time because walls can be raised with a non-possible speed by other methods.

The pillars and walls do not need any fresh element that sets; they have high resistance which, along with the characteristics already mentioned, makes them suitable to offer immediate raising capacity.

In a preferable embodiment, the pillars are of square section with free-standing capacity, which is obtained by providing alternatively successive layers of two blocks that are linked to successive superior layers when turning ninety degrees their orientation. In the walls with free-standing capacity, somewhat, the standing capacity is obtained when successive block layers are placed and the link with the superior successive layers is made without the need to turn the direction of such.

Regarding the strength, due to the composition of Portland cement mortar and steel fibers in the appropriate proportions, each block supports loads of 16t pure compression.

Another result of the block design and alternatively intercalating in the junction of the walls encounter the blocks so they are simultaneously fit in both walls; its right angle walls are obtained that allow achieving, at the same time, in the considered corner a monolithism of equal order of the one of each wall itself.

The corners are conformed in the same hollow columns that are in the rest of the walls. These hollow columns can be used to produce reinforced concrete pillars in their interior if it is considered useful to the effects of providing additional stability.

Also, it is distinguishable to the facility to implement the installation of lights, water, or other services by means of interior canals that use the vertical hollow spaces of the walls.

The link between the blocks with each other causes the block to be set under compression forces, supported fundamentally by the mortar, and flexion and cut that are essentially supported by the steel fibers that integrate the mortar matrix. The content of steel fiber additionally confers a high resistance to impacts.

Lintel Beam

For the effects to totally allow the raising of walls with prefabricated elements a lintel beam is introduced.

The lintel beam is a piece having a cross-sectional section identical to the block, the length is equivalent to a multiple of the block length and the longitudinal section is equal to the one obtained by placing several aligned blocks. The volume is equivalent to the volume of combining several blocks in which the hollow openings symmetrically placed have been filled up; thus, they are parallelepipeds having a solid rectangular base with solid protrusions that overpass them, joined among them.

Its reinforcement is equivalent to that of a traditional beam.

The ends of the lintel beam have the same form of a block which confers a type of uniform fit in for the whole structure. These ends are those that link the lintel beam to the masonry allowing a fit in with the rest of the wall.

Its function is double: they can serve as lintel beam in openings; but, in addition, placing them in series, can function as career beam or crown beam, according to the case.

They may be prefabricated of several lengths being advisable to limit them, for simplicity as well as for economy, in addition to the inherent conditioning to the work manipulation and design factors.

The lintel beam has main reinforcement, secondary reinforcement, and stirrups according to the usual design hypotheses in reinforced concrete, and they are made with the same material of the blocks including the steel fibers.

Head

The head block is use to provide a space for windows and doors.

This piece allows to easily construct a ledge, as well as to finish off the crowning of a wall or a crown beam in a uniform way offering a smooth surface when it is required for construction reasons.

It is prefabricated with the same material of the above identified block.

It derives from the design of the block because starting from the block design, the protrusions are eliminated and the rectangular base parallelepiped is provided with a solid superior face.

The solid superior face is obtained by filling the superior prismatic segments of the hollow cavities of the mentioned parallelepiped.

It is linked by means of the inferior face where they are the two cavities or female elements constituted by the prismatic hollow cavities symmetrically placed that are equivalent to the inferior segments of the hollow cavities of the rectangular parallelepiped that forms part of a block.

The head-block is fit in an inferior block by means of the previously mentioned male/female, because the protrusions of the inferior block are fit in the cavities that are opened in the inferior face of the head-block.

Semi-Block

In addition, a semi-block is added which, along with the lintel beam, allows forming a space suitable to tie down windows or doors by means of suitable adherences.

It is a piece derived from the block.

Starting from a block as it has been described; a transversal cross-sectional section is performed as previously described to obtain two identical semi-blocks.

The semi-blocks are fit in blocks in order to complete the lateral closing of the wall in those places where they need to be implemented, for example, spaces destined to windows and doors, or joining of walls.

Next to the lintel beam, the semi-block allows producing a space suitable for the frame for the windows or doors by means of suitable adherences, for example, a wall anchor.

Characteristic of the Wall

The composition of the elements of the mortar-cement, water, and sand including its mesh allows to obtain a wall of texture comparable to texture of a plastered wall, that along with its resistance, allows leaving out the plaster for interior as well as for exterior.

The mentioned texture and consistency grant a suitable impermeability, making it only necessary to perform the sealing of the superficial junctions that form in the ornament between the pieces, with cement mortar or a suitable pastine. This sealing may be applied by a person that does not have any technical skill in a similar way to the enforcement of joints, for example, ceramic pieces or floor tiles.

The morphology of these pieces and link also grant facility and monolithism in the execution of the wall joints and the corners in right angle that prevail at general level.

From the point of view of the work schedule, it is obtained a shortening of the same by way of eliminating the necessity of habitual waiting times that assure a minimum structural resistance in traditional resistant elements, as well as to eliminate delays due to the incidence of the adverse weather in outdoor work.

The use of the block and the pieces derived from it, with the characteristics described for the raising of pillars and inner and outer walls, constitutes an integral constructive system. This system assures the fast emergence of complementary elements like doors, windows, or ceilings.

In addition, it is to emphasize the remarkable resistance to impact that confers the steel fiber content, important point for a wall that is designed to be without interior or exterior plaster.

Construction of a Room or a Building

To build a room having a length “L”, a width “A”, and a height “H”, the user may carefully calculate that the predetermined measures of the room are multiples of the measurements of the blocks and the complementary blocks taking into account the openings for windows and doors. It is important to avoid having to modify the size of the blocks and/or the complementary blocks in order to keep the physical integrity of the blocks or complementary blocks.

The room according to the present invention may be built on any standard foundation for conventional masonry brick or blocks. The user may check the proper; leveling of the foundation, and then the user may outline the perimeter of the foundation with the blocks, leaving free the openings for the doors that connect adjacent rooms.

The second row of blocks may be placed by interconnecting the block to two adjacent blocks on the first row. The same operation occurs for the corners, where even the axes of the blocks of the concurrent walls form a 90 degree angle, the measurement allows the upper block to produce a mechanical link between both walls.

The complementary blocks are key elements in order to assure the same type of mechanical linkage to create the openings for doors and/or windows.

Several rooms may be linked together in order to create a building.

The coronation of all openings is ensured through the positioning and clip-on of the one of the complementary blocks, the beam, according to the present invention.

The roofing of the building may be made by means of any standard roofing system.

The building according to the present invention does not use any additional internal or external structural support, for the purposes of ensuring the stability of the building and the appropriate surface resistance of the walls.

The building material of the blocks in conjunction with the matter of linking the blocks and complementary blocks ensures the appropriate surface resistance of the walls of the building comparable to a wall of reinforced concrete or masonry including internal or external structural support.

The above statement is based on the values of resistance to bending and cutting which is capable of withstanding the wall made with the system described.

A Working Embodiment

Next, a working embodiment is described without meaning in any way some limitation in the reach of this request for patent, since it is possible to always give other measures to the block and other pieces obtaining the same results, as long as the proportion between the measures is maintained.

Block

In a preferred form to obtain an easily manageable volume by the workers, by its dimensions as well as by its weight, and considering a suitable wall width, the rectangular base parallelepiped has a length of 30 cm, a width of 15 cm, and a height of 10 cm, whereas the protrusions has a length of 10 cm, a width of 10 cm and a height of 4.5 cm.

From the inferior face of the rectangular base parallelepiped, it is possible to access the two cavities or female elements constituted by the prismatic inferior segments of the hollow cavities symmetrically placed. Each one of these prismatic segments has a length of 11 cm, a width of 11 cm, and a height of 5 cm.

Between the internal faces of the inferior segments of both hollow cavities there is a separation of 4 cm. From the external faces of the inferior segments of both hollow cavities there is a separation of 2 cm with respect to the lateral faces of the parallelepiped.

The prismatic superior segments of the hollow cavities symmetrically placed have a length of 7 cm, a width of 7 cm, and a height of 5 cm.

The protrusions measure 10 cm in length, 10 cm in width, and 4.5 cm in height, whereas the inner hollow cavities measure 7 cm in length, 7 cm in width, and 4.5 cm in height.

The protrusions symmetrically placed in the superior face of the block have a separation among them of 5 cm, and each one of them moved away 2.5 cm of the respective lateral faces of the parallelepiped. The thickness of the walls of the protrusions is of 1.5 cm.

The described measures constitute a preferred example by the inventor, without for that reason, limiting the reach of this request of patent. The mentioned measures can change if the proportions are maintained.

When placing the blocks one next to another, and one fit in the other as a male/female, layers or rows of blocks are formed that allow to raise as an example columns, inner or outer walls.

The fit in between pieces allows forming square pillars of 30 cm of side with standing capacity, this is obtained by alternatively placing layers of two blocks that link with the superior layers when turning ninety degrees their direction.

The height of the pillars and the walls is a multiple of the height of the block. In the above mentioned example it is a multiple of 10 cm. This is particularly useful in the case of using foundation stall, in which case the pillars may be placed as an additional ceiling support.

Lintel Beam

For the case of rectangular base block type of a length of 30 cm, a width of 15 cm, and a height of 10 cm, the beams may be made with a section of 15 cm of base by 10 cm of height, which limits the amount of reinforcement to be placed.

Its weight must be so that it allows to manipulate it and to place it in the wall with facility, to such effects, in a manufacture example for the previously mentioned case, is considered to prefabricate the lintel beams of two lengths, that is to say: of 1.20 m for lintels of doors, and 1.50 m for lintels of windows. The fact that the beam door lintel has 1.20 m allows a free light of 90 cm to the effects to locate the door and the frame. The length of the lintel beam of window of 1.50 m allows that the width of the window with the frame is 1.20 m.

In the case of the beams, section lintels 15 cm by 10 cm and 1.50 cm of overall length, its total weight is approximately of 65 kg, which allows that two workers position it in the work area without great difficulty.

Head-Block

Starting from the design of the block, and having eliminated the protrusions, the superior hollow segments of the parallelepiped that are filled up have a length of 7 cm, width of 7 cm and a height of 5 cm.

From the inferior face of the head-block, it is possible to access the two cavities or female elements constituted by the prismatic hollow cavities symmetrically placed.

Each one of these volumes has a length of 11 cm, a width of 11 cm, and a height of 5 cm.

Semi-Block

Starting from the block as it has been described; a cross-sectional section is performed in the block to obtain two identical semi-blocks.

Consequently, starting from the measures previously described for the block, it is possible to easily deduce the measures of the semi-block.

Industrial Application

The blocks are feasible products to be produced exclusively at industrial level by means of matrix or molds, which facilitates the necessary quality control and made possible the desirable scale economies.

The semi-blocks, which can be obtained by sectioning blocks with common equipment, are feasible industrially prefabricated by means of matrices or molds.

The head-block and the beams can only be prefabricated industrially by means of matrices or molds obtaining the desirable standardization.

Being made of Portland cement mortar reinforced with steel fibers, the prefabricated blocks and complementary blocks included in this invention need to be made by using pressure molding at room temperature. Said molds, support abrasion cement ranges typically ranging from 50,000 to 100,000 cycles or more of use. The use of processes involving work at temperatures between 50° C. and 250° C., such as injection molding of plastic materials is completely discarded by three separate reasons:

a) Accelerated deterioration of internal metal parts of the injectors:

You cannot use an injector for plastics to inject cement because the abrasiveness of the cement will ruin the interior walls of burnished steel of the apparatus, unless that after each cycle the apparatus is completely disassembled and thoroughly cleaned. Obviously, such a process would cost so much and it is not recommended, since it would be taking about one or two days of work to disassemble, clean, and assemble the apparatus. Although the apparatus is perfectly cleaned, could not be used because the abrasion.

b) Material properties required by the thermoplastics injector:

Regardless of the damage of working with Portland cement mortar reinforced with steel fibers in the interior of thermoplastic injectors, which would produce accelerated wear of metal parts, or nozzle clogging, it is necessary to consider the type of material required to work with the injectors. The materials are required to have a deformation temperature within the range of use of the injector (50° C. -250° C.), since the viscosity of the material increases as the temperature increases. This allows the material to flow into the interior of the injectors, which, combined with the pressure applied, it molds the piece. In the case of a Portland cement mortar, which is a type of concrete, the opposite effect occurs in an injector. The injector's high working temperatures accelerate the chemical setting reaction of the cement mixture, causing the cement to react rapidly, presenting a rapid stiffening of the molding mass.

In case we have two equal cements at different temperatures, the one that is at the lower temperature is always the more fluid, just the opposite to thermoplastic materials. Thus, many specifications require that the concrete to have a temperature equal or below 32° C. ASTM C 94 (AASHTO M 157), specification records the difficulties that can occur when the temperature is about 32° C. The ideal working temperatures according to several standards are comprised between 20° C. to 30° C. (68° F. to 86° F.), as specified in ASTM C 192 (AASHTO T 126, IRAM 1534, NTC 1377, NMX-C-159).

c) Loss of strength of the blocks as a result of the operating temperatures of the injectors:

There is a third inherent reason for the desired properties in the block, and is therefore the most important, which completely excludes subjecting the material of the pieces during the manufacturing process to high temperatures, just the opposite case of thermoplastic materials that need high temperatures during the manufacturing process. Increasing the temperature in the concrete correlates widely with a low mechanical strength of the pieces at later ages since the setting.

In some embodiment, the building may be at least two stories high.

What is claimed is:

1. A room comprising:

at least four freestanding walls;

each of the four freestanding walls consisting of:

at least one of a block;

at least one of a semi-block;

at least one of a lintel beam; and at least one of a head beam;

wherein the at least one block, the at least one semi-block, the at least one lintel beam, and the at least one head beam are made of a material consisting of Portland cement, sand, water, and steel fibers;

wherein the at least one block consists of:

a base having a top end, a bottom end, two separate cavities symmetrically placed inside the base, and hollow protrusions extending over the top end of the block, wherein the cavities run from the top end to the bottom end of the base; and each hollow protrusion is connected to one of the cavities;

each cavity includes:

a first segment located near the bottom end of the base having a square shape with a first longitudinal dimension;

a second segment connected to the first segment, the second segment having a square base with a second longitudinal dimension;

the first longitudinal dimension is greater than the second longitudinal dimension; and a step formed at a point where the first segment connects with the second segment;

wherein the at least one block, the at least one semi-block, the at least one lintel beam, and the at least one head beam in a compression test are capable of sustaining a load of 16 tons;

wherein each one of the at least one block, the at least one semi-block, the at least one lintel beam, and the at least one head beam is a pressure molding block formed without any heat treatment;

wherein the at least one block, the at least one semi-block, the at least one lintel beam, and the at least one head interconnect to each other;

wherein walls are formed by connecting successive layers of the at least one block, the at least one semi-block, the at least one head-block, and the at least one lintel beam, by said protrusions and first segment, one next to the other or one over the other; and wherein the at least one block, the at least one semi-block, the at least one head-block, and the at least one lintel beam connect to each other free of an external structural support, plaster, an internal structural support, an adhesive, a mortar mixture, and support beams.

* * * * *